US011319178B2

(12) United States Patent
Inoue

(10) Patent No.: US 11,319,178 B2
(45) Date of Patent: May 3, 2022

(54) SHEET CONVEYANCE APPARATUS AND IMAGE FORMING APPARATUS

(71) Applicant: CANON KABUSHIKI KAISHA, Tokyo (JP)

(72) Inventor: Kozo Inoue, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 75 days.

(21) Appl. No.: 16/585,176

(22) Filed: Sep. 27, 2019

(65) Prior Publication Data

US 2020/0122943 A1 Apr. 23, 2020

(30) Foreign Application Priority Data

Oct. 17, 2018 (JP) ..... JP2018-196202

(51) Int. Cl.

| | |
|---|---|
| ***B65H 9/00*** | (2006.01) |
| ***B65H 7/08*** | (2006.01) |
| ***B65H 7/20*** | (2006.01) |
| ***B65H 43/00*** | (2006.01) |

(52) U.S. Cl.

CPC ..... *B65H 9/006* (2013.01); *B65H 7/08* (2013.01); *B65H 7/20* (2013.01); *B65H 43/00* (2013.01); *B65H 2513/10* (2013.01); *B65H 2513/108* (2013.01); *B65H 2513/50* (2013.01); *B65H 2801/06* (2013.01)

(58) Field of Classification Search

CPC . B65H 9/006; B65H 7/08; B65H 7/20; B65H 43/00; B65H 2513/108; B65H 2513/50

See application file for complete search history.

(56) References Cited

U.S. PATENT DOCUMENTS

| | | | | |
|---|---|---|---|---|
| 8,006,976 | B2 * | 8/2011 | Suzuki | B65H 7/02 271/270 |
| 8,814,163 | B2 * | 8/2014 | Yamagata | B65H 5/34 271/270 |
| 8,864,132 | B2 * | 10/2014 | Yamagata | B65H 9/006 271/264 |
| 9,944,483 | B2 * | 4/2018 | Inoue | B65H 9/006 |
| 2019/0161300 | A1 * | 5/2019 | Katto | G03G 15/6529 |

FOREIGN PATENT DOCUMENTS

JP 2013091535 A 5/2013

* cited by examiner

*Primary Examiner* — Jeremy R Severson

(74) *Attorney, Agent, or Firm* — Rossi, Kimms & McDowell LLP

(57) ABSTRACT

In a conveyance operation, a leading edge of a sheet in a sheet conveyance direction is abutted against a second conveyance member in a stopped state while a first drive source is driving a first conveyance member at the first speed, and then a second drive source starts to drive the second conveyance member with a target of a second speed while the first drive source is continuously driving the first conveyance member. A speed change processing is executed during the conveyance operation, such that the first drive source changes the first conveyance member from the first speed to a third speed that is smaller than the second speed before the second conveyance member reaches the second speed, and then changes the first conveyance member from the third speed to the second speed.

12 Claims, 8 Drawing Sheets

SHEET CONVEYANCE APPARATUS AND IMAGE FORMING APPARATUS

BACKGROUND OF THE INVENTION

Field of the Invention

The present invention relates to a sheet conveyance apparatus for conveying sheets and an image forming apparatus configured to form an image on a sheet.

Description of the Related Art

In an image forming apparatus such as a printer, a copying machine, a multi-function printer and the like, a sheet conveyance apparatus is used widely in which skewing of the sheet is corrected by abutting a leading edge of the sheet used as a recording material or a document to a registration roller in a stopped state, making the sheet warped for skew correction. Further, a technique is known where throughput of the sheet conveyance apparatus is improved by starting drive of the registration roller at an appropriate timing after skewing of the sheet is corrected without stopping the drive of the sheet conveyance roller arranged upstream of the registration roller.

In the sheet conveyance apparatus adopting the above-described technique, before the rotational speed of the registration roller catches up with the rotation speed of the sheet conveyance roller, warping of the sheet grows by the speed difference of the rollers. In this case, there is a need to take measures against preventing buckling of the sheet by the excessive increase of warping exceeding a warping amount required for skew correction, such as by ensuring a sufficiently wide space within a sheet conveyance path. In contrast, Japanese Patent Application Laid-Open Publication No. 2013-091535 proposes temporarily stopping or decelerating the sheet conveyance roller after starting drive of the registration roller to thereby reduce warping of the sheet.

However, as a result of the investigation performed by the inventors, it has been observed that in a case where the sheet conveyance roller is temporarily stopped or decelerated as taught in the above-described document, there were cases where stability of sheet conveyance was deteriorated. That is, according to a configuration where sheet conveyance speed fluctuates when the leading edge of the sheet is abutted against the registration roller in a stopped state, amount of reduction of warping by temporarily stopping or decelerating the sheet conveyance roller may become too much or too little. If the amount of reduction of warping is excessive, the sheet may be tensioned between the sheet conveyance roller and the registration roller, by which the conveyance speed or position of the sheet may be disordered. Meanwhile, if the amount of reduction of warping is too little, buckling of the sheet may occur between the sheet conveyance roller and the registration roller.

SUMMARY OF THE INVENTION

The present invention provides a sheet conveyance apparatus and an image forming apparatus capable of realizing a stable sheet conveyance.

According to one aspect of the invention, a sheet conveyance apparatus includes: a first conveyance member configured to convey a sheet; a second conveyance member arranged downstream of the first conveyance member in a sheet conveyance direction and configured to convey the sheet; a detection unit configured to detect the sheet at a detection position upstream of the second conveyance member in the sheet conveyance direction; a first drive source configured to drive the first conveyance member; a second drive source configured to drive the second conveyance member; and a control unit configured to determine a value of a first speed for each sheet based on a timing at which the detection unit detects the sheet and to execute a conveyance operation in which a leading edge of the sheet in the sheet conveyance direction is abutted against the second conveyance member in a stopped state while the first drive source is driving the first conveyance member at the first speed, and then the second drive source starts to drive the second conveyance member with a target of a second speed while the first drive source is continuously driving the first conveyance member, wherein the control unit is configured to execute a speed change processing, during the conveyance operation, in which the first drive source changes the first conveyance member from the first speed to a third speed that is smaller than the second speed before the second conveyance member reaches the second speed, and then changes the first conveyance member from the third speed to the second speed.

According to another aspect of the invention, an image forming apparatus includes: a sheet conveyance apparatus configured to convey a sheet; and an image forming unit configured to form an image on the sheet conveyed by the sheet conveyance apparatus, wherein the sheet conveyance apparatus includes: a first conveyance member configured to convey a sheet; a second conveyance member arranged downstream of the first conveyance member in a sheet conveyance direction and configured to convey the sheet; a detection unit configured to detect the sheet at a detection position upstream of the second conveyance member in the sheet conveyance direction; a first drive source configured to drive the first conveyance member; a second drive source configured to drive the second conveyance member; and a control unit configured to determine a value of a first speed for each sheet based on a timing at which the detection unit detects the sheet and to execute a conveyance operation in which a leading edge of the sheet in the sheet conveyance direction is abutted against the second conveyance member in a stopped state while the first drive source is driving the first conveyance member at the first speed, and then the second drive source starts to drive the second conveyance member with a target of a second speed while the first drive source is continuously driving the first conveyance member, wherein the control unit is configured to execute a speed change processing, during the conveyance operation, in which the first drive source changes the first conveyance member from the first speed to a third speed that is smaller than the second speed before the second conveyance member reaches the second speed, and then changes the first conveyance member from the third speed to the second speed.

Further features of the present invention will become apparent from the following description of exemplary embodiments with reference to the attached drawings.

DESCRIPTION OF THE EMBODIMENTS

Now, an exemplary embodiment of the invention will be described with reference to the drawings.

Figure 1:
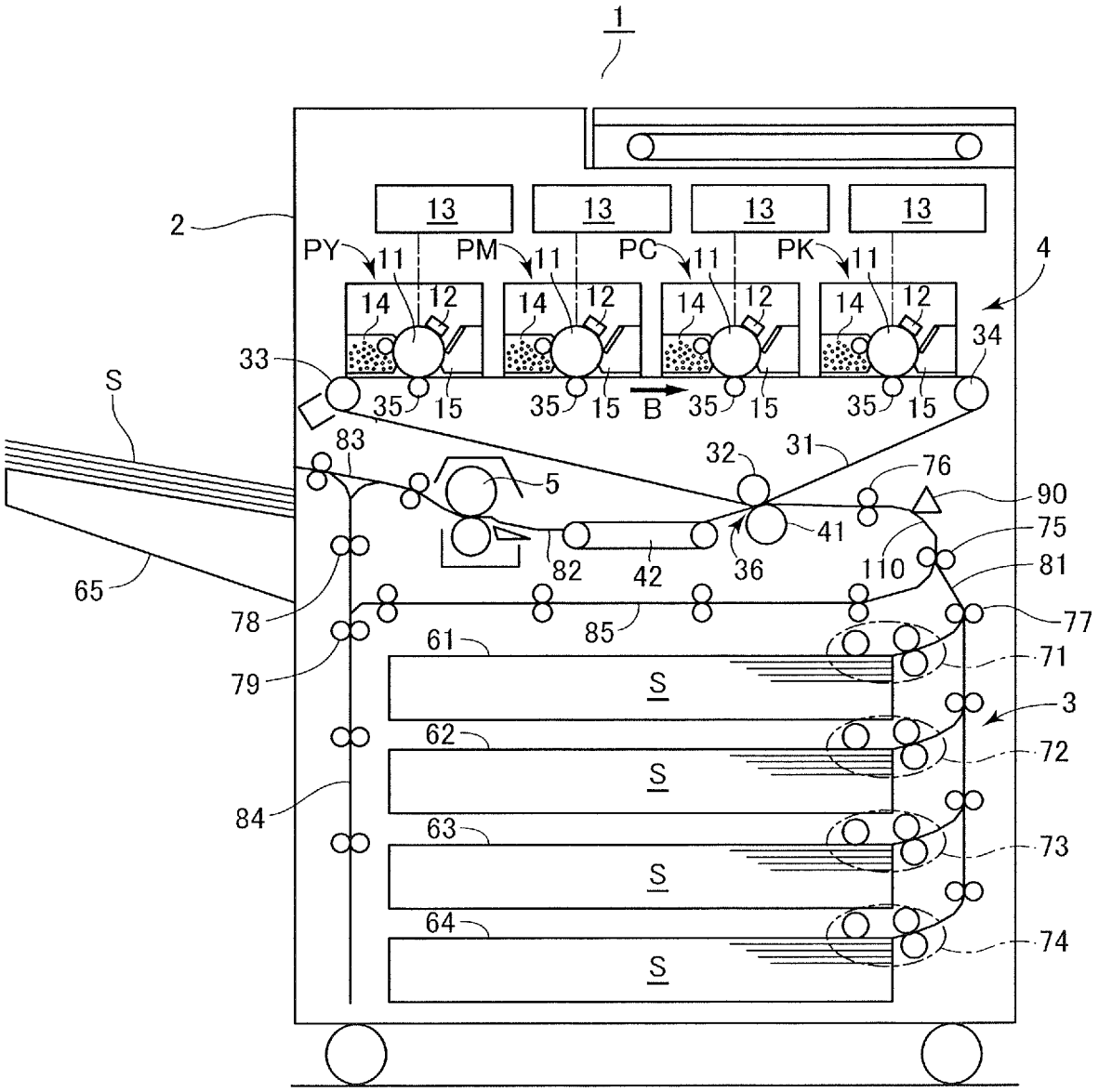
FIG. 1 is a schematic drawing of an image forming apparatus according to an embodiment of the present disclosure.

As illustrated in FIG. 1, a printer 1 serving as an image forming apparatus according to the present embodiment includes a sheet feeding portion 3 configured to convey a sheet S and an image forming unit 4 for forming an image on the sheet S being fed from the sheet feeding portion 3, which are arranged inside an apparatus body 2. The printer 1 forms an image on the sheet S based on image information read from a document using an image reading apparatus or image information received from an external computer connected to the printer 1. The sheet S used as recording material includes paper such as plain paper and thick paper, plastic films such as overhead projector transparency, special sheets such as envelopes and index sheets, and cloths.

The image forming unit 4 is composed of four processing stations PY, PM, PC and PK, an intermediate transfer unit including the intermediate transfer belt 31, and a fixing unit 5. The respective processing stations PY through PK include photosensitive drums 11 serving as photoconductors, and form yellow, magenta, cyan and black toner images through electrophotographic processes. That is, charging devices 12 charge surfaces of the photosensitive drums 11 uniformly, and exposing devices 13 emit light modulated based on the image information to expose the photosensitive drums 11 and form electrostatic latent images on the drum surfaces. Developing units 14 supply charged toner particles to the photosensitive drums 11 and develop the electrostatic latent images into toner images. The toner images borne on the photosensitive drums 11 are primarily transferred by primary transfer rollers 35 to the intermediate transfer belt 31. Transfer residual toner and other attached substances that remain on the photosensitive drums 11 without being transferred are removed by drum cleaners 15.

In parallel with such electrophotographic process, the sheet feeding portion 3 feeds the sheets S one by one toward the image forming unit 4. The sheet feeding portion 3 is disposed in a lower portion of the apparatus body 2, and includes sheet feed cassettes 61 through 64 serving as sheet storage portions that store the sheets S and sheet feed units 71 through 74 that send out the sheets S stored in the respective cassettes. The sheet S sent out from one of the sheet feed units 71 through 74 is conveyed through a sheet conveyance path that extends in a substantially vertical direction, i.e., vertical path 81, and conveyed via the conveyance rollers 77 and 75 toward an alignment roller 76. The sheet S is abutted against the alignment roller 76 and is warped, and a leading edge of the sheet, i.e., a downstream end in the sheet conveyance direction, is aligned at a nip portion of the alignment roller 76, by which skewing of the sheet S is corrected. A conveyance roller 75 serving as a first conveyance member of the present embodiment is also referred to as a pre-registration roller pair, and an alignment roller 76 serving as a second conveyance member of the present embodiment is also referred to as a registration roller pair.

The intermediate transfer belt 31 is wound around a drive roller 33, a tension roller 34 and a secondary transfer inner roller 32, and rotates in a direction along a rotation direction of the photosensitive drums 11, that is, clockwise direction in the drawing. By transferring the toner images of respective colors formed by the processing stations PY through PK so that they are superposed on one another, a full-color toner image is formed on an intermediate transfer belt 51. The toner image borne on the intermediate transfer belt 31 is conveyed to a nip portion, that is, a secondary transfer portion 36, formed between the intermediate transfer belt 31 and a secondary transfer roller 41 opposed to the secondary transfer inner roller 32. The secondary transfer roller 41 serving as a transfer member according to the present embodiment secondarily transfers the toner image to the sheet S at the secondary transfer portion 36 by applying bias voltage having opposite polarity to a normal charge polarity of toner image. In this process, the alignment roller 76 conveys the sheet S subjected to skew correction to the secondary transfer portion 36 so that the timing at which the toner image borne on the intermediate transfer belt 31 reaches the secondary transfer portion 36 matches the timing at which the sheet S enters the secondary transfer portion 36. Attached substances such as transfer residual toner remaining on the intermediate transfer belt 31 without being transferred to the sheet S are removed by a belt cleaner provided in contact with the intermediate transfer belt 31.

The sheet S that has passed the secondary transfer portion 36 is conveyed by a pre-fixture conveyance unit 42 to the fixing unit 5. The fixing unit 5 includes a pair of rotary members that nips the sheet S and rotates, and a heating element such as a halogen heater for heating the toner image, by which the toner image on the sheet S is heated and pressed while being conveyed. Thereby, toner is melted and fixed, and the toner image is fixed to the sheet S. In the present embodiment, a horizontal conveyance configuration is adopted where image is transferred and fixed to the sheet S while the sheet S is conveyed approximately in the horizontal direction, and the alignment roller 76, the secondary transfer portion 36 and the fixing unit 5 are arranged along a horizontal path 82 that extends approximately in the horizontal direction.

The conveyance route of the sheet S having passed the fixing unit 5 is determined by a branching unit 83. In the case of simplex printing, the sheet S is guided to a sheet discharge roller pair to be discharged from the apparatus body 2 and stacked on a sheet discharge tray 65. In duplex printing, the sheet S to which forming of image to a first side is completed is guided to a reverse conveyance path 84, subjected to switchback by conveyance rollers 78 and 79 on the reverse conveyance path 84, and passed onto a re-conveyance path 85. The sheet S passes through the re-conveyance path 85 and is conveyed again by the conveyance roller 75 and the alignment roller 76 in a state where the first and second sides are turned over, and by passing the secondary transfer portion 36 and the fixing unit 5, an image is formed on a second side. The sheet S to which forming of image to the second side has been completed is discharged by the sheet discharge roller pair to the sheet discharge tray 65.

The image forming unit 4 that transfers images to the sheet from the intermediate transfer belt 31 serving as an example of an image bearing member is an example of an image forming unit, and it is also possible to use an electrophotographic unit adopting a direct transfer system in which the toner image formed on a photosensitive drum serves as an image bearing member. Further, a mechanism other than an electrophotographic system, such as an ink-jet system or an offset printing system, can be used as the image forming unit.

Sheet Feed Unit

Figure 2:
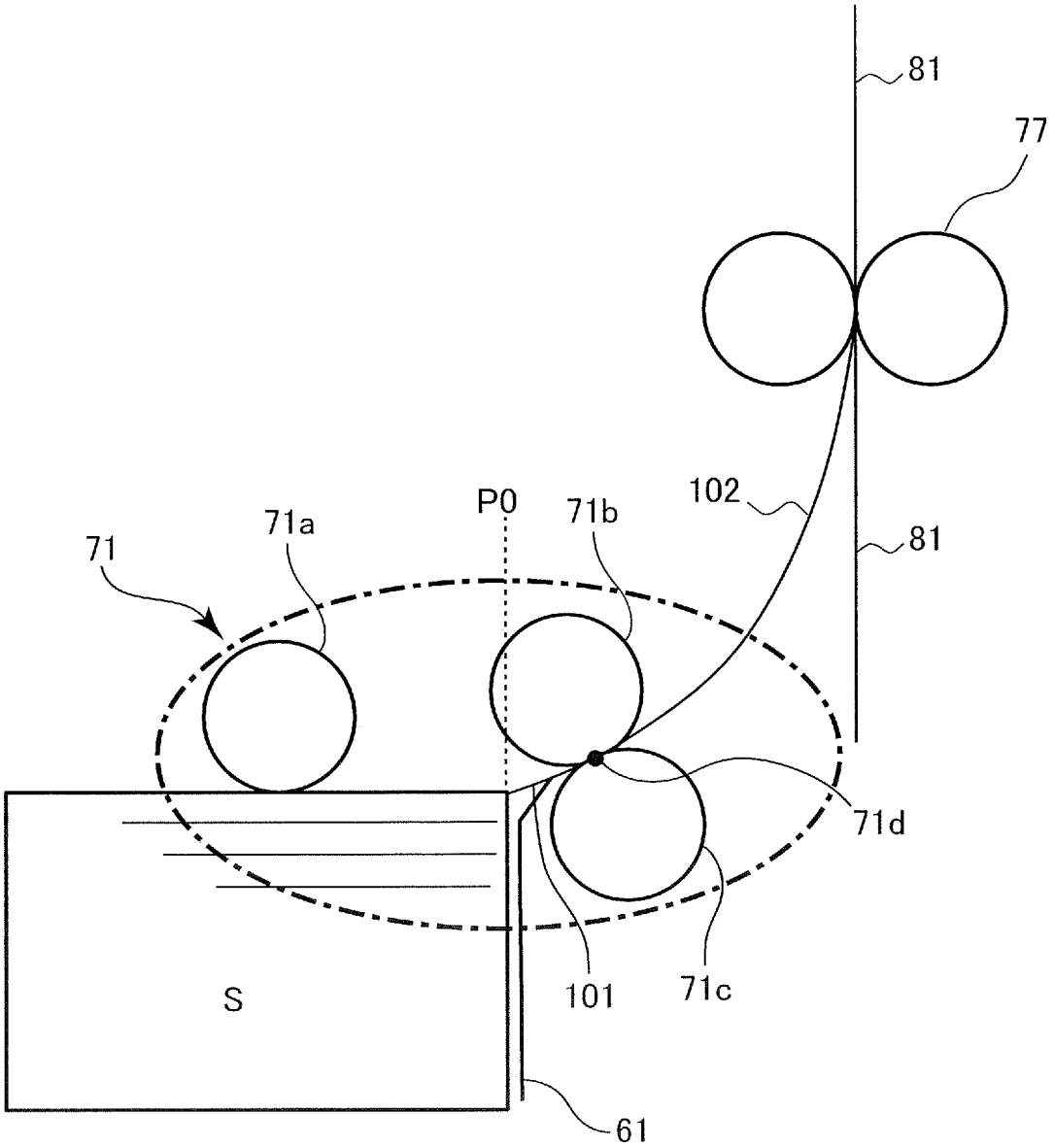
FIG. 2 is a schematic drawing of a sheet feeding portion according to the present embodiment.

FIG. 2 is a schematic drawing illustrating a configuration of a sheet feed unit 71. The other sheet feed units 72 to 74 have the same configurations, so that the descriptions thereof are omitted.

The sheet feed unit 71 includes a pickup roller 71*a*, a feed roller 71*b* and a retard roller 71*c*. The pickup roller 71*a* is arranged above a sheet feed cassette 61, comes into contact with an uppermost sheet of the sheets S stored in the cassette and rotates, to send the uppermost sheet to a sheet conveyance path 101 leading to the feed roller 71*b*. The feed roller 71*b* conveys the sheet S received from the pickup roller 71*a* through a sheet conveyance path 102 to a conveyance roller 77. The conveyance roller 77 is arranged at a merging portion between the vertical path 81 and the sheet conveyance path 102 and conveys the sheet S fed from one of the sheet feed units 71 through 74 upward toward the conveyance roller 75 (FIG. 1).

The retard roller 71*c* is a separation member that contacts the feed roller 71*b* and separates the sheet S from other sheets at a separation nip 71*d* formed between the feed roller 71*b* and the retard roller 71*c*. Drive force in a direction against rotation of the feed roller 71*b*, that is, counterclockwise direction in the drawing, is entered to the retard roller 71*c* via a torque limiter. If there is only one sheet S in the separation nip 71*d*, the retard roller 71*c* is rotated in the clockwise direction in the drawing by the feed roller 71*b* because of the frictional force received from the sheet S while letting the torque limiter slip. If multiple sheets S enter the separation nip 71*d*, the retard roller 71*c* rotates in the counterclockwise direction in the drawing while letting the sheets slip against one another, and pushes back the sheets other than the uppermost sheet S in contact with the feed roller 71*b* toward the sheet feed cassette 61.

The sheet feed unit 71 is an example of a sheet feeding portion that feeds sheets one at a time from the sheet storage portion. Instead of the above-described configuration, for example, a sheet feed unit that feeds sheets by a belt member, or a sheet feed unit that is not equipped with a pickup roller 71*a* and the feed roller 71*b* is used to feed the sheet S from the sheet feed cassette 61, may be used as the sheet feeding portion.

As illustrated in FIG. 1, an alignment sensor 90 serving as a detection unit for detecting sheets is arranged between the alignment roller 76 and the conveyance roller 75 that is arranged next to the alignment roller 76 on an upstream side in a sheet conveyance direction. As the alignment sensor 90, a photo-reflector that irradiates light toward a conveyance path and detects reflected light from a sheet or a photo-interrupter for detecting that a flag protruding to the conveyance path is swung by a sheet coming into contact therewith can be used. The alignment sensor 90 is also referred to as a registration sensor.

Figure 3:
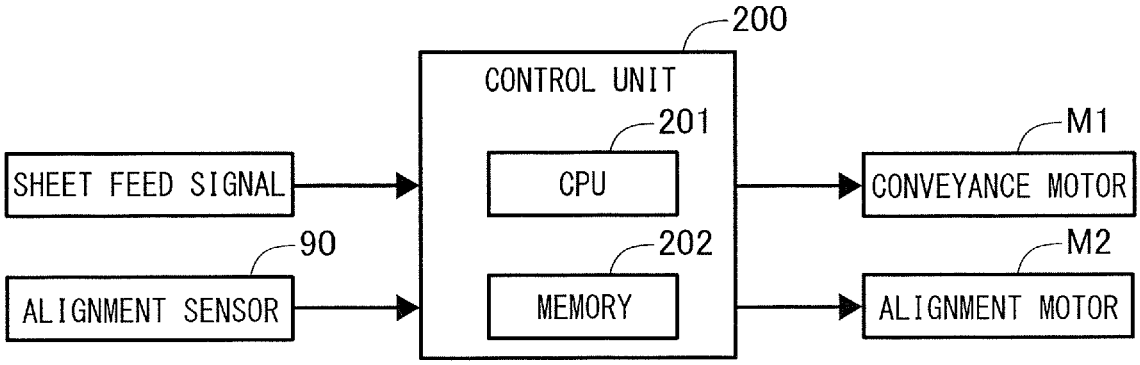
FIG. 3 is a block diagram illustrating a configuration for controlling a sheet conveyance operation according to the present embodiment.

The alignment sensor 90 is connected to a control unit 200 illustrated in FIG. 3. The control unit 200 according to the present embodiment is a control board mounted to the apparatus body 2 of the printer 1, and includes a central processing unit (CPU) 201 and a memory 202. The CPU 201 reads and executes programs stored in the memory 202, and controls the operation of the whole printer 1 including the sheet feeding portion 3 and the image forming unit 4. The memory 202 includes a volatile storage media and a non-volatile storage media, and they are used not only as storage location of programs and data but also as workspace when the CPU 201 executes programs.

The above-described sheet feed unit 71 and conveyance rollers 75 and 77 are driven by a conveyance motor M1 serving as a first drive source of the present embodiment. Further, the alignment roller 76 is driven by an alignment motor M2 serving as a second drive source of the present embodiment. When a sheet feed signal is entered, the CPU 201 is configured to execute the sheet conveyance operation by controlling the drive state of the conveyance motor M1 and the alignment motor M2 based on detection signals from the alignment sensor 90. Specifically, the CPU 201 transmits drive signals that designate rotational speed of the motor and the like to drive circuits of the conveyance motor M1 and the alignment motor M2, and the drive circuits supply current to the motors based on the drive signals to drive the motors. Further, the sheet feed signal is a signal that demands sheets to be fed from the sheet feeding portion 3, and it is generated, for example, when an instruction to start printing is entered by operating an operation portion of the printer 1.

Conveyance Speed Control

Control of conveyance speed in the sheet conveyance operation will now be described. As described below, according to the present embodiment, a configuration is adopted where skew correction of the sheet and conveyance to the secondary transfer portion 36 is performed without stopping the drive of the conveyance rollers 75 and 77.

1. Overview of Conveyance Speed Control

Figure 4:
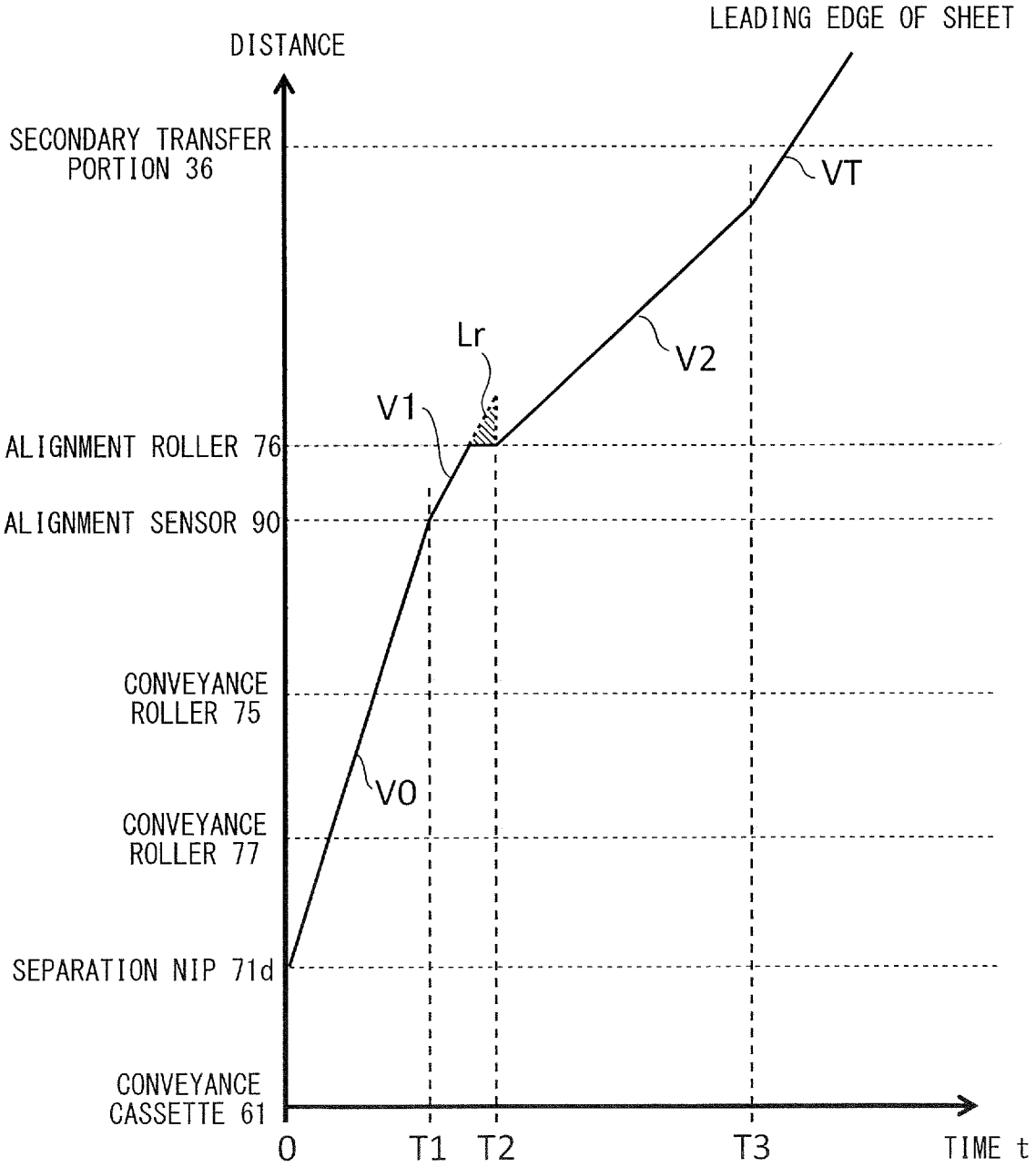
FIG. 4 is a chart illustrating an overview of a sheet conveyance operation according to the present embodiment.

FIG. 4 is a line graph illustrating an example of transition of conveyance speed in a sheet conveyance operation. Horizontal axis indicates elapsed time of sheet conveyance operation from a time at which conveyance has been started, i.e., start of drive of the sheet feed unit 71 by the conveyance motor M1. Vertical axis indicates positions of a leading edge of a sheet in a conveyance path from the sheet feed cassette 61 toward the secondary transfer portion 36.

When the sheet conveyance operation is started, the conveyance motor M1 drives a sheet feed unit 100 so that the conveyance speeds of the pickup roller 71*a* and the feed roller 71*b* are set to V0. Here, in the present embodiment, conveyance speed of the sheet by a certain roller refers to a peripheral speed of the roller. A leading edge of a sheet when sheet conveyance operation is started is typically positioned between a regular set position P0 (refer to FIG. 2) with respect to the sheet feed cassette 61 and the separation nip 71*d* where separation of the sheet is performed.

The sheet sent out by the sheet feed unit 100 is further conveyed by the conveyance roller 77 and the conveyance roller 75 driven by the conveyance motor M1. In this example, the conveyance roller 77 and the conveyance roller 75 are assumed to be driven at the same speed V0 as the start of conveyance.

Since the surface of the roller may slip against the sheet, conveyance efficiency (actual movement speed of the sheet with respect to set conveyance speed) will not always be 100%. For example, during the time before the sheet reaches the conveyance roller 77, that is, while the leading edge of the sheet is positioned within the sheet conveyance paths 101 and 102 (FIG. 2), the sheet is conveyed only by the sheet feed unit 100, so that the conveyance efficiency is known to be deteriorated compared to the periods that follow. Meanwhile, it is known that the conveyance efficiency reaches a value close to 100% after the leading edge of the sheet arrives at the conveyance roller 77. Therefore, in the following description, it is assumed that the conveyance speed coincides the actual movement speed.

When the leading edge of the sheet sent from the conveyance roller 75 reaches the detection position of the alignment sensor 90, a signal, i.e., ON signal, indicating that a sheet has been detected by the alignment sensor 90 is output. Then, based on the detection timing of the alignment sensor 90, the CPU 200 changes the conveyance speed of the conveyance rollers 75 and 77 from speed V0 to a speed (hereinafter referred to as pre-registration speed V1) by which the sheet is abutted against the alignment roller 76. The alignment roller 76 is stopped at a point of time when the speed of the conveyance rollers 75 and 77 has been changed, and the leading edge of the sheet contacts and is stopped at the nip portion of the alignment roller 76 in a stopped state. Meanwhile, the conveyance rollers 75 and 77 convey the sheet at pre-registration speed V1 even after the leading edge of the sheet has been abutted against the alignment roller 76, so that the sheet will be put in a warped state.

An area of a right-angled triangle (Lr) of FIG. 4 indicates an excessive sheet length that has been sent out to a section between the conveyance roller 75 and the alignment roller 76 during a period from when the leading edge of the sheet has come in contact with the alignment roller 76 to when driving of the alignment roller 76 has started. The right-angled triangle is defined by a straight line that extrapolates a section of the pre-registration speed V1 on the line graph, a horizontal line indicating a position of the alignment roller 76, and a vertical line showing a drive start time T2 of the alignment roller 76. This area indicates a level of warping, i.e., size of loop, of the sheet when correcting skewing of the sheet, and in the following description, it is referred to as a loop amount Lr.

The alignment roller 76 is started to be driven at time T2 and accelerated to a speed set as target speed (hereinafter referred to as a post-registration speed V2), which is determined through a specific method described later. Further, after a process of temporarily changing the conveyance speed is performed if necessary by the method described later, the speed of the conveyance roller 75 is changed to a speed approximately equal to the post-registration speed V2. The speed approximately equal to the post-registration speed V2 includes a state where there is little speed difference small enough that it does not affect the sheet conveyance operation while the trailing edge of the sheet passes through the conveyance roller 75, as described hereafter. For example, a target speed of the conveyance roller 75 during the above-described period can be set to a speed having a 5% speed difference with respect to the post-registration speed V2 of the alignment roller 76. After the conveyance roller 75 and the alignment roller 76 have reached the post-registration speed V2, at a time T3 before the leading edge of the sheet reaches the secondary transfer portion 36, the conveyance speeds of the alignment roller 76 and the conveyance rollers 75 and 77 are further changed to a processing speed VT. The processing speed VT is a sheet conveyance speed when secondary transfer is performed at the secondary transfer portion 36, and it corresponds to the peripheral speed of the intermediate transfer belt 31.

2. Determination of Pre-Registration Speed V1 and Post-Registration Speed V2

In the above-described conveyance speed control, the pre-registration speed V1 which is the first speed according to the present embodiment and the post-registration speed V2 which is the second speed according to the present embodiment are variables that are determined for each sheet in accordance with the detection timing of the alignment sensor 90 and the progress of the electrophotographic process at the image forming unit 4.

The pre-registration speed V1 is set to a value so as to compensate fluctuation in elapsed time (hereinafter referred to as detection time T1) from the start of sheet conveyance operation to the detection of the leading edge of the sheet by the alignment sensor 90. That is, the pre-registration speed V1 is determined so that a value of V1 in a case where the detection time T1 is a first length is less than a value of V1 in a case where the detection time T1 is a second length that is longer than the first length.

The reason why the detection time T1 is not constant is that slipping of the roller tends to occur in a state where the sheet is conveyed only by the sheet feed unit 71, that is, the conveyance efficiency is low, and that there is a variation in the position of the leading edge of the sheet at the conveyance start time. By determining the pre-registration speed V1 according to the detection time T1, the interval in which the alignment roller 76 sends out the sheet when feeding a plurality of sheets approximates a fixed interval. Thereby, throughput can be improved by narrowing the sheet interval as much as possible while avoiding the leading edge of a subsequent sheet from colliding against the trailing edge of a preceding sheet.

The post-registration speed V2 is determined so that a sheet is conveyed to a predetermined position, which is the secondary transfer portion 36 in this case, at a matched timing with the reaching of the toner image formed on the intermediate transfer belt 31 at the predetermined position, which is the secondary transfer portion 36. Actually, the post-registration speed V2 can be calculated by the following method.

Figure 5:
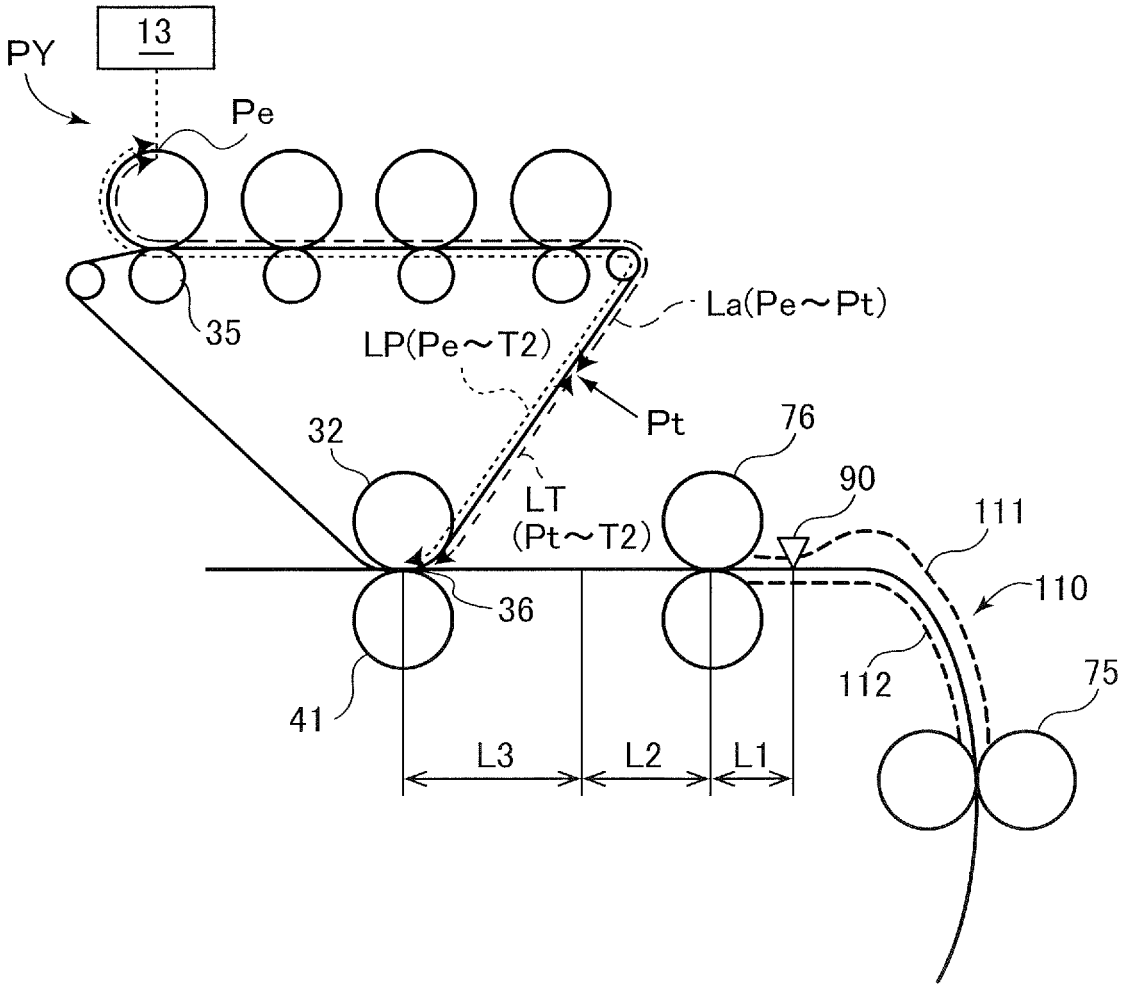
FIG. 5 is a schematic drawing illustrating a method for determining a conveyance speed according to the present embodiment.

At first, a distance LT of a toner image on the intermediate transfer belt to the secondary transfer portion 36 at a time (t=T1) when the leading edge of the sheet is detected by the alignment sensor 90 is calculated (refer to FIG. 5). LT satisfies the following relationship.

$$LT = LP - La, \quad \frac{La}{VT} = Ta + T1 \qquad \text{Expression 1}$$

Distance LP is a distance from an exposure position Pe on the photosensitive drum 11 concerning the exposing device 13 to the secondary transfer portion 36. In other words, the distance LP is a total distance of movement of one pixel constituting a recording image, which is drawn on the photosensitive drum 11 as electrostatic latent image, then developed as toner image, and finally reaches the secondary transfer portion 36. A distance La is a distance from the exposure position Pe to a leading edge position of toner image at the detection time T1 of the alignment sensor 90, that is, position closest to the secondary transfer portion 36. VT refers to a rotational speed, that is, processing speed, of the intermediate transfer belt 31, and Ta refers to an elapsed time from start of drive of the exposing device 13 to start of the sheet conveyance operation.

By solving the expression, LT is expressed as follows as a function of the detection time T1.

$$LT=LP-VT(Ta+T1) \quad \text{Expression 2}$$

The timing at which the toner image formed on the intermediate transfer belt 31 reaches the secondary transfer portion 36 and the timing at which the leading edge of the sheet reaches the secondary transfer portion 36 should be the same. Further, before the leading edge of the sheet reaches the secondary transfer portion 36, the sheet conveyance speed should be changed from the post-registration speed V2 to the processing speed VT, which is equal speed with the intermediate transfer belt 31. Therefore, a calculation formula for calculating the post-registration speed V2 is as follows.

$$\frac{LT}{VT}=\frac{L1+Lr}{V1}+\frac{L2}{V2}+\frac{L3}{VT} \quad \text{Expression 3}$$

L1 represents a distance from the detection position of the alignment sensor 90 to the alignment roller 76. Lr represents the loop amount Lr formed before the drive of the alignment roller 76 is started. L2 represents a distance in which the sheet is conveyed by the post-registration speed V2. L3 represents a distance in which the sheet is conveyed by the processing speed VT.

By solving the expression, the post-registration speed V2 will be expressed as follows.

$$V2=L2\Big/\left(\frac{LT-L3}{VT}-\frac{L1+Lr}{V1}\right) \quad \text{Expression 4}$$

In the above expression 4, parameters other than LT are determined before the sheet conveyance operation is started. That is, the distance L1 is determined by the arrangement of the alignment sensor 90, and the distances L2 and L3 are set in advance so that change of speed to the processing speed VT is completed reliably before the leading edge of the sheet reaches the secondary transfer portion 36. The loop amount Lr is set to such a size so that skewing of the sheet is corrected effectively. The loop amount Lr and the processing speed VT can be set to different values according to the sheet type, such as the grammage and the size of the sheet. These parameters (L1, L2, L3, Lr and VT) that are not varied regardless of the detection time T1 may be acquired by the CPU 201 reading out values stored in a nonvolatile storage area in the memory 202.

Meanwhile, in the above-mentioned expression 4, the pre-registration speed V1 and the distance LT may be varied sheet to sheet, so that it is necessary to acquire a new value each time a sheet conveyance operation is performed to a sheet. The pre-registration speed V1 is determined based on the detection time T1 of the alignment sensor 90, and the distance LT can be obtained by substituting the detection time T1 in expression 2. The acquired values V1 and LT are substituted in expression 4, by which the post-registration speed V2 is determined.

3. Excessive Looping

According to the present embodiment, in the above-described sheet conveyance operation, a processing is performed to keep a loop amount of the sheet within a certain range during a startup time of the alignment roller 76 immediately after starting drive thereof.

At first, with reference to FIGS. 6A and 6B, the generation of a loop at the startup time of the alignment roller 76 will be described. Here, in the following description, startup time of the alignment roller 76 refers to a period of time from the start of drive of the alignment roller 76 by the alignment motor M2 to a state where the conveyance speed of the alignment roller 76 has approximately become equal to the post-registration speed V2.

The respective drawings of FIGS. 6 and 7 have converted the vertical axis of the timing chart of the conveyance motor M1 and the alignment motor M2 respectively to conveyance speeds of the conveyance roller 75 and the alignment roller 76. That is, in the following description, "conveyance speeds" of the conveyance roller 75 and the alignment roller 76 are, unless stated otherwise, the speeds designated by the drive signals that the CPU 201 of the control unit 200 have output to the drive circuits of the conveyance motor M1 or the alignment motor M2. The actual rotational speed of the conveyance roller 75 and the alignment roller 76 may accompany delay or minute fluctuation compared to the illustrated graph, according to the response characteristics of the motor or the configuration of drive transmission mechanism from the motor to the roller.

Figure 6A:
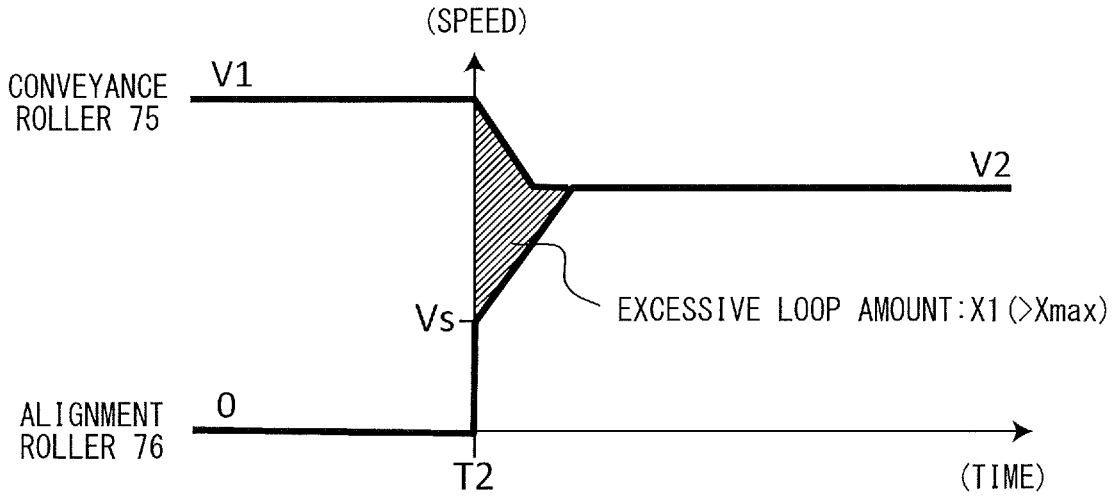
FIG. 6A is a chart illustrating an excessive loop amount.

FIG. 6A illustrates a transition example of conveyance speed of the alignment roller 76 and the conveyance roller 75. In a state prior to starting drive at time T2, the conveyance speed of the alignment roller 76 is 0, that is, stopped state, and conveyance speed of the conveyance roller 75 is the pre-registration speed V1. As described earlier, during a period of time when the alignment roller 76 is stopped, the leading edge of the sheet is abutted against the alignment roller 76, and a loop with a predetermined loop amount Lr is formed in the sheet.

When drive of the alignment roller 76 is started at time T2, the alignment roller 76 is accelerated to the post-registration speed V2. In addition, the conveyance speed of the conveyance roller 75 is also changed from the pre-registration speed V1 to the post-registration speed V2. Since the pre-registration speed V1 is set greater than the post-registration speed V2, the conveyance roller 75 is decelerated. The speed change processing of the conveyance roller 75 is started at time T2, simultaneously as the start of driving of the alignment roller 76.

The conveyance speeds of the alignment roller 76 and the conveyance roller 75 are not changed instantly at time T2, but the speeds are changed over some period of time depending on the acceleration performance or the deceleration performance of the alignment motor M2 and the conveyance motor M1. Therefore, until the alignment roller 76 is sufficiently accelerated and the conveyance speeds of the alignment roller 76 and the conveyance roller 75 become substantially equal, a state continues where the conveyance speed of the alignment roller 76 is slower than the conveyance speed of the conveyance roller 75. Then, because of the difference in conveyance speeds, the sheet length that exists between the conveyance roller 75 and the alignment roller 76 in a sheet conveyance path 110 (FIG. 1) is elongated, and the loop amount is increased beyond the predetermined loop amount Lr. The area shown by the shaded area in FIG. 6A indicates the loop amount that is applied to the sheet exceeding the predetermined loop amount by this mechanism, hereinafter referred to as excessive loop amount X1.

Conveyance guides 111 and 112 (refer to FIG. 5) that form the sheet conveyance path 110 are arranged to ensure a space wide enough to allow the sheet to be warped for a predetermined loop amount Lr without being buckled. However, if an excessive loop amount X1 that exceeds a threshold value Xmax (i.e., predetermined threshold) of the loop amount that the sheet conveyance path 110 allows is added to the startup time of the alignment roller 76, excessive length of sheet is crammed in the sheet conveyance path 110, and buckling of the sheet may occur. If buckling of the sheet occurs, jamming of the sheet caused by the warping of the sheet may occur, or creases may be formed on the product.

As a countermeasure, it may be possible to temporarily decelerate the conveyance roller 75 at the drive start time T2 of the alignment roller 76 and reduce to the speed thereof to a conveyance speed smaller than the post-registration speed V2. However, if the conveyance roller 75 is decelerated too much, the conveyance speed of the alignment roller 76 will be higher than the conveyance speed of the conveyance roller 75, and the sheet may be pulled between the alignment roller 76 and the conveyance roller 75. If pulling of the sheet occurs, the position of the sheet having been subjected to skew correction will be disturbed and skewing of the sheet may occur again, or displacement of position of the image may occur due to the deviation of the timing at which the sheet reaches the secondary transfer portion 36. Therefore, in a configuration where the conveyance roller 75 is decelerated at a uniform ratio with respect to the pre-registration speed V1 during the startup time of the alignment roller 76, or in a configuration where the conveyance roller 75 is decelerated to a fixed speed regardless of the pre-registration speed V1, it may not be possible to sufficiently reduce the buckling of the sheet or pulling of the sheet.

4. Threshold Speed Vc

Therefore, regarding the pre-registration speed V1, the threshold speed Vc that may be a guideline as to whether the excessive loop amount X1 exceeds the threshold value Xmax in a state where temporal speed change processing of the conveyance roller 75 is not performed is calculated in advance. The threshold speed Vc (i.e., predetermined threshold speed) is defined as a speed in which the excessive loop amount X1 becomes equal to the threshold value Xmax in a state where the pre-registration speed V1 and the post-registration speed V2 are both set to Vc and the speed change processing of the conveyance roller 75 is not performed during startup time of the alignment roller 76.

Figure 6B:
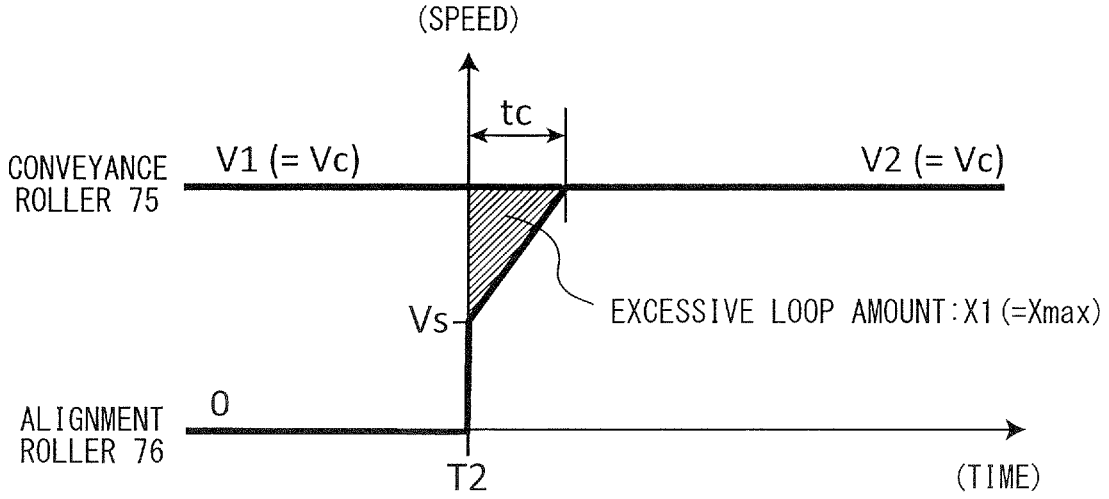
FIG. 6B is a chart illustrating a threshold speed Vc.

FIG. 6B is a view illustrating a method for calculating the threshold speed Vc. The conveyance roller 75 is driven at a fixed speed (Vc) during, before and after a startup time of the alignment roller 76, that is, from the drive start time T2 to the time at which the speed has reached the post-registration speed V2. In other words, V1=V2=Vc (constant). In this case, the excessive loop amount X1, that is, area of the hatching portion, that occurs by the difference in speed between the conveyance roller 75 and the alignment roller 76 is expressed by the following expression, wherein an acceleration of the alignment roller 76 is represented by "a", and necessary time for the alignment roller 76 to accelerate from an initial speed Vs to the threshold speed Vc is represented by tc.

$$X1 = Vc \cdot tc - \frac{1}{2}(Vs + Vc)tc,\ tc = \frac{Vc - Vs}{a} \qquad \text{Expression 5}$$

A stepping motor is used as the alignment motor M2, and the initial speed Vs is the conveyance speed of the alignment roller 76 in a state where the alignment motor M2 is driven by a present activation frequency.

By solving the expression for Vc, the following expression is obtained.

$$Vc = Vs + \sqrt{2aX1} \qquad \text{Expression 6}$$

In order to prevent buckling of the sheet by excessive looping, it is necessary for the total value of the loop amount Lr and the excessive loop amount X1 to fall within an allowable range of the sheet conveyance path 110 between the alignment roller 76 and the conveyance roller 75. Therefore, the threshold speed Vc can be calculated by substituting the threshold value Xmax of the excessive loop amount to the above expression 6 based on the initial speed Vs and the acceleration a determined by the specification of the alignment motor M2.

The threshold value Xmax of the excessive loop amount is calculated in advance by testing the loop amount where buckling is generated for the various types of sheets supported by the printer 1 according to the actual shape of the sheet conveyance path 110. For example, if the maximum allowable loop amount of the sheet conveyance path 110 is 9 mm, a margin of 1 mm is set, and the loop amount Lr for skew correction can be set to 4 mm and the threshold value Xmax of the excessive loop amount can be set to 4 mm, for example.

5. Deceleration Processing (if V1>Vc)

Now, we will describe cases where the pre-registration speed V1 is or is not greater than the threshold speed Vc when the leading edge of the sheet abuts against the alignment roller 76. At first, we will describe a case where the pre-registration speed V1 is greater than the threshold speed Vc. In this case, buckling of the sheet may occur by the excessive loop amount X1 exceeding the threshold value Xmax, so that in the speed change processing according to the present embodiment, a deceleration processing is performed in which the conveyance roller 75 is temporarily decelerated.

Figure 7A:
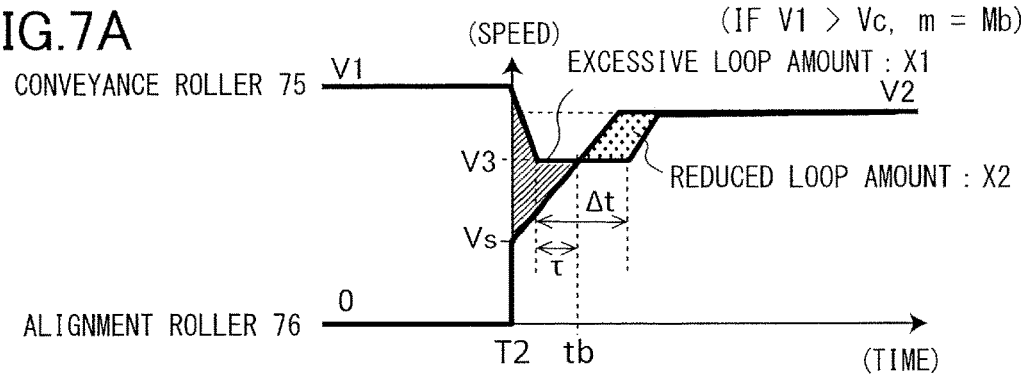
FIG. 7A is a chart of conveyance speed transition in a case where deceleration processing is executed according to the present embodiment.

FIG. 7A illustrates a transition example of conveyance speed of a case where the conveyance roller 75 is temporarily decelerated. Deceleration of the conveyance roller 75 in the state driven at pre-registration speed V1 is started at drive start time T2 of the alignment roller 76, and speed change processing of the conveyance roller 75 is performed to a regulating speed V3, which is the third speed according to the present embodiment. After time tb where the conveyance speed of the alignment roller 76 has exceeded the regulating speed V3, acceleration of the conveyance roller 75 is started, and the conveyance roller 75 is accelerated to a speed approximately equal to the post-regulation speed V2 of the alignment roller 76.

We will now describe the method for calculating the regulating speed V3, which is the target speed of the conveyance roller 75 in the deceleration processing. The regulating speed V3 is a parameter that is calculated for each sheet based on the value of the pre-registration speed V1, and as described below, it is determined so that a condition is satisfied where the excessive loop amount X1 does not exceed the threshold value Xmax. Further according to the present embodiment, a deceleration coefficient Mb, i.e., a speed change coefficient for deceleration, which is a ratio of regulating speed V3 and pre-registration speed V1 is used to determine whether to actually perform the deceleration processing. That is, the relationship of the pre-registration speed V1, the regulating speed V3 and the deceleration coefficient Mb in a state where deceleration processing is performed will be expressed by the following expression 7.

$$V3=Mb\cdot V1 \quad \text{Expression 7}$$

Figure 7B:
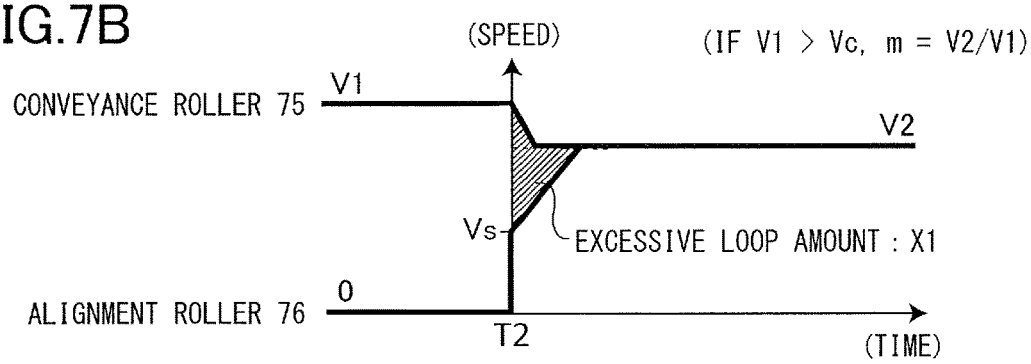
FIG. 7B is a chart of conveyance speed transition in a case where deceleration processing nor acceleration processing is not executed.

In order to obtain the value of the regulating speed V3, the excessive loop amount X1, that is, the area of the hatching portion in FIG. 7A, in a case where deceleration processing is performed with the regulating speed V3 set to a given value (v3) is expressed as follows. Here, as illustrated in FIG. 7E, S1 is the area of the region above speed v3, and S2 is the area of the region below speed v3. A deceleration where the conveyance roller 75 is decelerated from the pre-registration speed V1 to speed v3 is denoted by "b" (b>0), and the time required for deceleration, i.e., deceleration time, is denoted by "t3". The acceleration while the alignment roller 76 accelerates from initial speed Vs to speed v3 is denoted by "a", and the time required for acceleration, i.e., acceleration time, is denoted by "t4".

$$\begin{cases} X1 = S1 + S2 = \frac{1}{2}(V1 - v3)t3 + \frac{1}{2}(v3 - Vs)t4 \\ t3 = \frac{V1 - v3}{b} \\ t4 = \frac{v3 - Vs}{a} \end{cases} \quad \text{Expression 8}$$

Expression 8 can be reformed as follows.

$$\begin{aligned} X1 &= \frac{1}{2b}(V1 - v3)^2 + \frac{1}{2a}(v3 - Vs)^2 \\ &= \left(\frac{1}{2a} + \frac{1}{2b}\right)v3^2 - \left(\frac{V1}{b} + \frac{Vs}{a}\right)v3 + \frac{V1^2}{2b} + \frac{Vs^2}{2a} \end{aligned} \quad \text{Expression 9}$$

Solving expression 9 for v3, the following expression is obtained.

$$v3 = \frac{1}{a+b}\left\{aV1 + bVs + \sqrt{2ab(a+b)X1 - ab(V1 - Vs)^2}\right\} \quad \text{Expression 10}$$

By substituting Xmax in X1 of expression 10, a regulating speed V3 where the excessive loop amount is equal to the threshold value Xmax can be obtained. Then, based on the relationship of expression 7, the following calculation formula where the deceleration coefficient Mb is additionally included as a function of the pre-registration speed V1 is obtained.

$$\begin{aligned} Mb &= \frac{1}{(a+b)V1} \left\{\frac{aV1 + bVs +}{\sqrt{2ab(a+b)X\max - ab(V1 - Vs)^2}}\right\} \\ &= \frac{1}{a+b} \left\{\frac{a + b\frac{Vs}{V1} + \frac{1}{V1}}{\sqrt{2ab(a+b)X\max - ab(V1 - Vs)^2}}\right\} \end{aligned} \quad \text{Expression 11}$$

As described in the flowchart mentioned later, if V1>Vc, whether to perform deceleration processing is determined based on the value of the deceleration coefficient Mb. According to expressions 10 and 11, it seems that an imaginary solution exists, but since a maximum value is set for the pre-registration speed V1 according to the present embodiment, a real solution is always obtained.

6. Acceleration Processing (if V1<Vc)

Next, we will describe a case where the pre-registration speed V1 is smaller than the threshold speed Vc. If V1<Vc, the excessive loop amount X1 may become negative and pulling of the sheet may occur, so in another example of the speed change processing according to the present embodiment, an acceleration processing where the conveyance roller 75 is temporarily accelerated is performed.

Figure 7C:
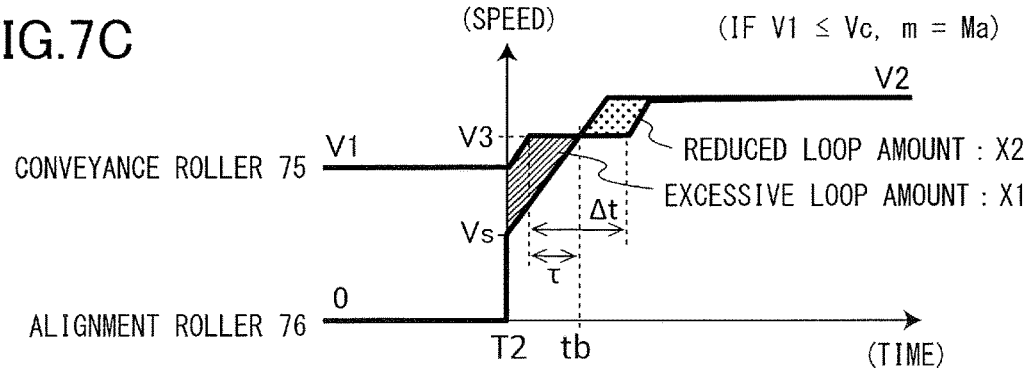
FIG. 7C is a chart of conveyance speed transition in a case where acceleration processing is executed.

FIG. 7C illustrates a transition example of conveyance speed in a state where the conveyance roller 75 is temporarily accelerated. From the state driven at pre-registration speed V1, acceleration of the conveyance roller 75 is started at drive start time T2 of the alignment roller 76, and speed change processing of the conveyance roller 75 is performed to a regulating speed V3 to drive the conveyance roller 75 at constant speed. Thereafter, acceleration of the conveyance roller 75 is resumed after time tb where the conveyance speed of the alignment roller 76 has reached the regulating speed V3, and the conveyance roller 75 is accelerated to a speed approximately equal to the post-registration speed V2 of the alignment roller 76.

We will now describe a method for calculating the regulating speed V3 which is the target speed of the conveyance roller 75 according to the acceleration processing. Similar to the case of deceleration processing, the value of regulating speed V3 according to the acceleration processing is a parameter calculated for each sheet based on the value of the pre-registration speed V1, and it is determined to satisfy a condition where the excessive loop amount X1 does not exceed the threshold value Xmax, as described later. Further, an acceleration coefficient Ma, i.e., a speed change coefficient for acceleration, which is a ratio of regulating speed V3 and pre-registration speed V1, is used to determine whether to actually perform acceleration processing. That is, the relationship of the pre-registration speed V1, the regulating speed V3 and the acceleration coefficient Ma in a case where acceleration processing is performed will be expressed by the following expression.

$$V3=Ma\cdot V1 \quad \text{Expression 12}$$

Figure 7D:
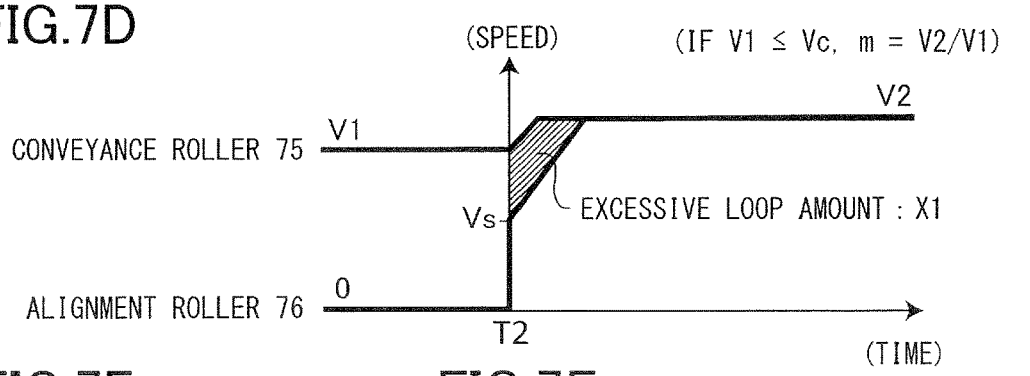
FIG. 7D is a chart of conveyance speed transition in a case where deceleration processing nor acceleration processing is not executed.
Figure 7E:
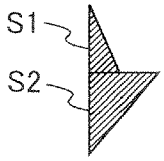
FIG. 7E is a supplement drawing illustrating a method for calculating the regulating speed V3.
Figure 7F:
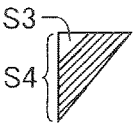
FIG. 7F is a supplement drawing illustrating a method for calculating the regulating speed V3.

In order to obtain the value of the regulating speed V3, the excessive loop amount X1 of a case where the acceleration processing is performed with the regulating speed V3 set to a given value (v3), that is, area of the hatching portion in FIG. 7B, will be expressed as follows. As illustrated in FIG. 7F, S4 denotes an area of a right-angled triangle including a hatching portion, and S3 denotes an area of a right-angled triangle excluding the hatching portion from S4. Further, acceleration of a case where the conveyance roller 75 is accelerated from the pre-registration speed V1 to speed v3 is denoted by "c", and time required for acceleration, i.e., acceleration time, is denoted by "t3". Further, acceleration of a case where the alignment roller 76 is accelerated from the initial speed Vs to speed v3 is denoted by "a", and the time required for acceleration, i.e., acceleration time, is denoted by "t4".

$$\begin{cases} X1 = -S3 + S4 = \frac{1}{2}(V1 - v3)t3 + \frac{1}{2}(v3 - Vs)t4 \\ t3 = \frac{V1 - v3}{c} \\ t4 = \frac{v3 - Vs}{a} \end{cases} \quad \text{Expression 13}$$

Solving the above expression for v3 in a similar manner as in the case of deceleration processing, a regulating speed V3 in which the excessive loop amount is the threshold value Xmax can be obtained. Based on the relationship of expression 12, the calculation formula of the acceleration coefficient Ma is given by the following expression.

$$Ma = \frac{1}{(a+c)V1} \left\{ \frac{aV1 + cVs +}{\sqrt{2ac(a+c)X\max - ac(V1 - Vs)^2}} \right\} = \frac{1}{a+c} \left\{ \frac{a + c\frac{Vs}{V1} + \frac{1}{V1}}{\sqrt{2ac(a+c)X\max - ac(V1 - Vs)^2}} \right\} \quad \text{Expression 14}$$

If the acceleration c and the deceleration b of the conveyance roller 75 are equivalent, the above calculation formula is the same as the calculation formula (expression 11) of the deceleration coefficient Mb. As described with reference to the flowchart mentioned later, in the case of V1≤Vc, whether to perform acceleration processing is determined based on the value of the acceleration coefficient Ma.

7. Method for Controlling Conveyance Speed

Figure 8:
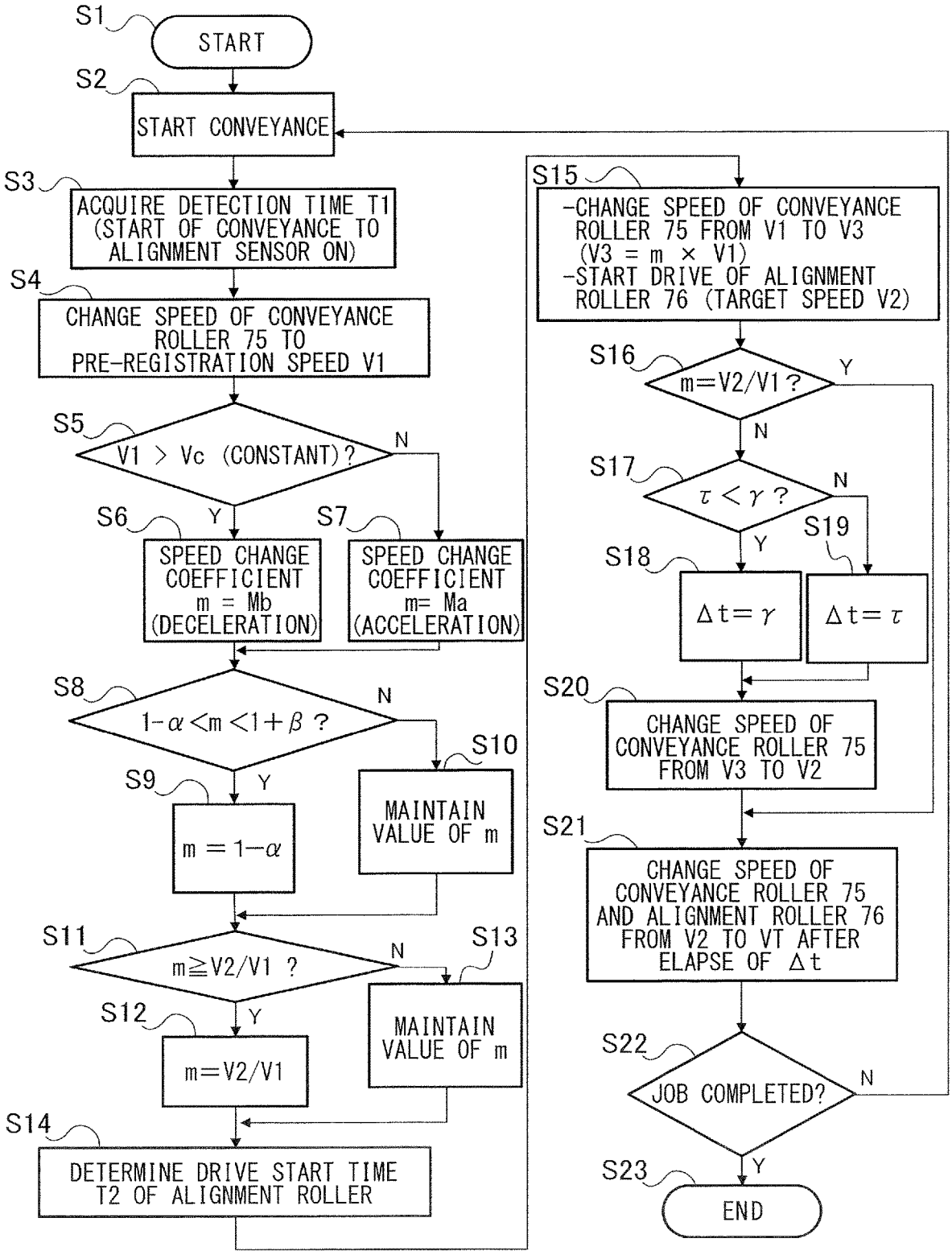
FIG. 8 is a flowchart illustrating a method for controlling the sheet conveyance operation according to the present embodiment.

Now, a method for controlling sheet conveyance speed in the sheet conveyance operation will be described with reference to the flowchart of FIG. 8. The respective steps of the processing illustrated in FIG. 8 is processed by the CPU 201 of the control unit 200 (FIG. 3) reading and executing the program stored in the memory 202.

This process is started when a sheet feed signal is entered to the control unit 200 (S1). If a task for conveying sheets, i.e., feed job, is generated by the sheet feed signal, a single sheet is conveyed from the designated cassette of the sheet feed cassettes 61 through 64 by the sheet feed units 71 through 74 (S2). In this case, the conveyance motor M1 is controlled so that the conveyance speed of the conveyance rollers 75 and 77 is speed V0.

In a state where the leading edge of the sheet reaches the detection position of the alignment sensor 90 and the alignment sensor 90 detects a sheet, the CPU 201 acquires the detection time T1, that is, elapsed time from start of sheet feed to detection of the alignment sensor 90 (S3). Based on the detection time T1, the pre-registration speed V1 is determined according to the above-described method, and the conveyance speed of the conveyance rollers 75 and 77 are changed to the pre-registration speed V1 (S4). Thereafter, in a state where the sheet is conveyed by pre-registration speed V1, a loop is formed to the sheet by the leading edge of the sheet abutting against the nip portion of the alignment roller 76 in the stopped state.

Hereafter, prior to starting drive of the alignment roller 76 in S15, the target speed of the conveyance roller 75 at the startup time of the alignment roller 76 is determined by the processes of S5 through S13. At first, the pre-registration speed V1 determined in S4 is compared with the threshold speed Vc determined in advance (S5). In the case of V1>Vc, the deceleration coefficient Mb is selected as the speed change coefficient of the conveyance roller 75, and the value of the deceleration coefficient Mb is calculated using expression 11 (S6). In the case of V1≤Vc, the acceleration coefficient Ma is selected as the speed change coefficient of the conveyance roller 75, and the value of the acceleration coefficient Ma is calculated using expression 14 (S7).

Next, whether the speed change coefficient m (Ma or Mb) obtained in S7 or S8 is within a range of fluctuation range set in advance is determined (S8). That is, assuming that width fixity coefficients of speed change processing which is a constant set in advance are α and β (0<α<1, 0<β<1), whether 1−α<m<1+β is satisfied is determined. If the speed change coefficient m is within the above-described range, the value of the speed change coefficient m is substituted by 1−α(S9). If it is out of the above-described range, the speed change coefficient m is maintained at the value of the acceleration coefficient Ma or the deceleration coefficient Mb obtained in S6 or S7 (S10).

Regarding S8 and S9, for example, if α=0.1 and β=0.1 are set, if the value of the speed change coefficient m obtained in S6 or S7 is within the range of 0.9 to 1.1, the speed change coefficient m is overwritten as m=0.9. This means that if the acceleration processing or the deceleration processing of the conveyance roller 75 is performed, deceleration of 10% is performed uniformly if the regulating speed V3 falls within a fluctuation range of ±10% of the pre-registration speed V1.

Further, if the value of the speed change coefficient m obtained by the processes to S10 is greater than the ratio of the post-registration speed V2 and the pre-registration speed V1 (that is, in the case of m≥V2/V1), the value of m can be substituted by V2/V1 (S11, S12). The result of S11 will be yes (Y) if the regulating speed V3 calculated so that the excessive loop amount X1 is equal to the threshold value Xmax, is equal to or greater than the post-registration speed V2 which is the target speed after starting drive of the alignment roller 76. In this case, as illustrated in FIGS. 7B and 7D, from the viewpoint of suppressing the excessive loop amount X1 to the threshold value Xmax or smaller, there is no need to change the speed of the conveyance roller 75 to the regulating speed V3. Therefore, by substituting the value of the speed change coefficient m with V2/V1, deceleration processing and acceleration processing can be omitted, and it is determined that at the same time as the start of driving of the alignment roller 76, speed change processing is started with the target of the post-registration speed V2.

Meanwhile, if m<V2/V1 (S11: N), the value of speed change coefficient m obtained by the processing to S10 is maintained (S13). In this case, simultaneously as the start of driving of the alignment roller 76, if speed change processing of the conveyance roller 75 is started with the post-registration speed V2 set as a target while omitting deceleration processing or acceleration processing, the excessive loop amount X1 may exceed the threshold value Xmax. Therefore, as illustrated in FIGS. 7A and 7C, by performing deceleration processing or acceleration processing of the conveyance roller 75 according to the value of the speed change coefficient m, the excessive loop amount X1 can be controlled to the threshold value Xmax or smaller.

If the value of speed change coefficient m is determined, the drive start time T2 of the alignment roller 76 is determined. That is, the CPU 201 calculates an elapsed time t2 from when the leading edge of the sheet is detected by the alignment sensor 90 to a state where the sheet is warped to a predetermined loop amount L4 by the pre-registration speed V1 determined in S4 (S14). The drive start time T2 of the alignment roller 76 is a time obtained by adding the above-described elapsed time t2 to the detection time T1 of the alignment sensor 90 based on feed start time.

At drive start time T2 of the alignment roller 76, the target speed of the conveyance roller 75 is set to regulating speed V3 (=m×V1) according to speed change coefficient m and the target speed of the alignment roller 76 is set to post-registration speed V2, and acceleration or deceleration of the conveyance roller 75 and the alignment roller 76 is started. In this case, if the value of the speed change coefficient m is maintained in S13, the regulating speed V3 is set to a value different from the value of post-registration speed V2 (S16: N), and the deceleration processing (if m=Mb) or the acceleration processing (if m=Ma) of the conveyance roller 75 is executed.

When performing deceleration processing or acceleration processing according to the present embodiment (S15 to S20 in the case where S16 is N), as illustrated in FIGS. 7A and 7C, acceleration or deceleration of the conveyance roller 75 is started at drive start time T2 of the alignment roller 76 (S15). Thereafter, at a point of time when a constant-speed time Δt has elapsed after the conveyance speed of the conveyance roller 75 has been set to regulating speed V3, speed change processing of the conveyance roller 75 from the regulating speed V3 to the post-registration speed V2 is started (S20). Constant-speed time Δt refers to the time during which the conveyance speed, that is, speed designated by the drive signal, of the conveyance roller 75 during the deceleration processing and the acceleration processing is maintained at the regulating speed V3, and the method for determining the same (S17 to S19) will be described later. In a state where the conveyance speed of the conveyance roller 75 is approximately equal to the post-registration speed V2 of the alignment roller 76, the deceleration processing or the acceleration processing is ended.

Meanwhile, if S12 is set to m=V2/V1 (S16: Y), the deceleration processing and the acceleration processing are not executed, and a speed substantially equal to the post-registration speed V2 is set as target speed of the conveyance roller 75 at the drive start time T2 of the alignment roller 76. In this case, the conveyance speed of the conveyance roller 75 is changed successively from the pre-registration speed V1 to a speed approximately equal to the post-registration speed V2, and that speed is maintained (FIGS. 7B and 7D).

After the conveyance speed of the alignment roller 76 and the conveyance roller 75 are changed to the post-registration speed V2, the conveyance speed of the respective rollers is changed to the processing speed VT (S21). As described, the speed change processing is performed at a predetermined timing determined to match the timing at which the toner image reaches the secondary transfer portion 36 and the timing at which the leading edge of the sheet enters the secondary transfer portion 36. The above-described processing from S2 to S21 is executed repeatedly until the number of sheets designated in the sheet feed job are fed (S22). If the above-described processing is executed for all the sheets, the job is completed (S23).

The contents of the processing of S17 to S19 will be described. If deceleration processing or acceleration processing is executed, it is necessary to perform speed change processing of the conveyance roller 75 within a relatively short time before the processing (S21) is started for changing the sheet conveyance speed from the post-registration speed V2 to the processing speed VT. Therefore, according to the present embodiment, in order to enhance stability of sheet conveyance, the length of constant-speed time Δt during which the speed of the conveyance roller 75 is maintained at the regulating speed V3 is set to be equal to or longer than a minimum necessary length of time γ for converging the actual rotational speed of the conveyance roller 75 to the regulating speed V3. The value of the minimum necessary length of time γ (also referred to as stabilization time or setting time) is determined as a time required for the rotational speed of the motor to fall within an allowable error, such as 2%, with respect to the set speed, and is dependent on the response characteristics of the conveyance motor M1.

Further according to the present embodiment, the speed change processing for changing the speed of the conveyance roller 75 from the regulating speed V3 to the post-regulation speed V2 is started later than time tb when the alignment roller 76 exceeds the regulating speed V3 (S20). The reason why the speed change processing of the conveyance roller 75 is started after the time tb is that if the speed change processing of the conveyance roller 75 to the post-registration speed V2 is started before time tb, the excessive loop amount X1 may exceed the threshold value Xmax.

That is, the constant-speed time Δt is determined as follows (S17 to S19).

$$\Delta t = \max(\gamma, \tau) \qquad \text{Expression 15}$$

T is the length of time from the time at which the conveyance speed of the conveyance roller 75 is set to the regulating speed V3 to the time at which the conveyance speed of the alignment roller 76 exceeds the regulating speed V3, and it can be expressed as $\tau=(V3-Vs)/a$ using the initial speed Vs and acceleration a of the alignment roller 76. The stability of sheet conveyance can be improved while suppressing the excessive loop amount X1 to not exceed the threshold value Xmax by setting the constant-speed time Δt to satisfy the above-mentioned expression 15.

If speed change processing of the conveyance roller 75 is started after time tb, that is, if $\tau<\gamma$, a period occurs during which the conveyance speed of the conveyance roller 75 is smaller than the conveyance speed of the alignment roller 76, as illustrated in FIGS. 7B and 7D. During this period, the speed in which the alignment roller 76 sends out sheets from the sheet conveyance path 110 exceeds the speed in which the conveyance roller 75 guides the sheets into the sheet conveyance path 110, so that the loop amount in the sheet conveyance path 110 is reduced. Therefore, the final loop amount R at the point of time when the deceleration processing or the acceleration processing is completed can be expressed as R=Lr+Xmax−X2, using the predetermined loop amount Lr, the threshold value Xmax of the excessive loop amount and a reduced loop amount X2. The reduced loop amount X2 corresponds to the amount of loop being reduced during the period in which the conveyance speed of the conveyance roller 75 is smaller than the conveyance speed of the alignment roller 76.

In the above expression, if R>0 is satisfied, pulling of the sheet by the alignment roller 76 and the conveyance roller 75 can be prevented. In other words, X2<Lr−Xmax should be satisfied for the reduced loop amount X2. In order to do so, the settable range of post-registration speed V2 of the alignment roller 76 must be set so that the above-described inequal equation is satisfied regarding the values of L4, Xmax and Δt (=γ). For example, if the conveyance motor M1 utilizes a motor such as the PM motor (permanent magnet type synchronous motor) in which a relatively long stabilization time is set, where γ is equal to or greater than 100 ms, for example, the reduced loop amount X2 tends to be high, so that the maximum value of the post-registration speed V2 is set relatively small. Meanwhile, if the conveyance motor utilizes a motor such as the HB motor (hybrid-type stepping motor) in which a relatively short stabilization time can be set, where γ is equal to or smaller than 50 ms, for example, the reduced loop amount X2 will not be high. In such case, the maximum value of the post-registration speed V2 can be set high compared to the PM motor. Further, if a system that requires very little stabilization time, such as vector control, is adopted as the method for controlling the motor, Δt becomes approximately equal to T and the reduced loop amount X2 approximately becomes 0, so that there is no need to set a maximum value for the post-registration speed V2 from the viewpoint of avoiding pulling of the sheet.

Advantages of Present Embodiment

As described, according to the present embodiment, speed change processing is executed using speed change coefficient m that is calculated so that the excessive loop amount X1 is equal to the threshold value Xmax or lower according to the pre-registration speed V1 of the conveyance roller 75. Thereby, compared to a configuration where deceleration is performed at a uniform ratio with respect to the pre-registration speed V1, for example, buckling of the sheet and pulling of the sheet can be solved at the same time and stability of sheet conveyance can be improved. In the speed change processing, as described above, the value of the regulating speed V3 should be changed in accordance with the value of the pre-registration speed V1 so that the regulating speed V3 becomes high if the pre-registration speed V1 is relatively low and the regulating speed V3 becomes low if the pre-registration speed V1 is relatively high, as described above. In expression 11, when V1>0, Mb is monotonically decreased with respect to V1. That is, in deceleration processing, the second drive source is controlled so that if the first speed (V1) is a first value, the third speed (V3) is set to a second value, and if the first speed is a third value that is greater than the first value, the third speed is set to a fourth value that is smaller than the second value.

Further, in the present embodiment, whether deceleration processing is necessary is determined based on the pre-registration speed V1, and deceleration processing is performed if V1 is greater than the threshold speed Vc and a certain condition is satisfied (S5: Y, S11: N). That is, if the first speed (V1) is set to a fifth value (≤Vc), deceleration processing is not executed in the conveyance operation, and if the first speed is a sixth value (>Vc) which is greater than the fifth value, deceleration processing is executed. Thereby, if it is determined that deceleration processing is not to be performed, deceleration processing is executed only when the excessive loop amount exceeds the threshold value Xmax, so that buckling of the sheet and pulling of the sheet can be solved at the same and stability of sheet conveyance can be improved. That is, in a case where there is little need to have the regulating speed V3 depend on the pre-registration speed V1, such as if the fluctuation range of the pre-registration speed V1 is relatively small, it may be possible to use the regulating speed V3 as fixed value to simply determine whether to perform deceleration processing.

Modified Examples

In the embodiment illustrated above, the speed change timing of the conveyance roller 75 when performing the deceleration processing or the acceleration processing, that is, the timing at which the speed change processing from the pre-registration speed V1 to the regulating speed V3 is started, is the same as the drive start time T2 of the alignment roller 76. However, advantages similar to the above-described embodiment can be obtained by performing deceleration processing or acceleration processing so that at least a portion of the constant-speed time Δt overlaps with the startup time of the alignment roller 76.

Further, as a method for calculating numerals that must be obtained each time a sheet is conveyed, such as the pre-registration speed V1 and the regulating speed V3, a correspondence stored in the memory 202 can be used instead of the method for obtaining the values by substituting the detection time T1 and the like in the function as described above. For example, a table representing a correspondence of the detection time T1 and the deceleration coefficient Mb computed in advance using expression 14 can be stored in the memory 202, and the detection time T1 acquired when executing the sheet conveyance operation can be used to obtain the deceleration coefficient Mb.

Further, the conveyance speed control according to the present embodiment is not limited for application to the sheet conveyance apparatus that supplies sheets to the image forming unit, and it can be applied to a sheet conveyance apparatus, which is so-called an Auto Document Feeder, that conveys sheets serving as documents in an image reading apparatus.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-196202, filed on Oct. 17, 2018, which is hereby incorporated by reference herein in its entirety.

What is claimed is:

1. A sheet conveyance apparatus comprising:

a first conveyance member configured to convey a sheet;

a second conveyance member arranged downstream of the first conveyance member in a sheet conveyance direction and configured to convey the sheet;

a detection unit configured to detect the sheet at a detection position upstream of the second conveyance member in the sheet conveyance direction;

a first drive source configured to drive the first conveyance member;

a second drive source configured to drive the second conveyance member; and a control unit configured to determine a value of a first speed for each sheet based on a timing at which the detection unit detects the sheet and to execute a conveyance operation in which a leading edge of the sheet in the sheet conveyance direction is abutted against the second conveyance member in a stopped state while the first drive source is driving the first conveyance member at the first speed, and then the second drive source starts to drive the second conveyance member with a target of a second speed while the first drive source continues to drive the first conveyance member, wherein the control unit is configured to execute a speed change processing, during the conveyance operation, in which the first drive source changes the first conveyance member from the first speed to a third speed that is smaller than the second speed before the second conveyance member reaches the second speed, and then changes the first conveyance member from the third speed to the second speed.

2. The sheet conveyance apparatus according to claim 1, wherein the control unit is configured to execute the speed change processing so that the third speed is a second value in a case where the first speed is a first value and that the third speed is a fourth value smaller than the second value in a case where the first speed is a third value greater than the first value.

3. The sheet conveyance apparatus according to claim 2, wherein in a case where the first speed is a fifth value that is smaller than the first value and the third value, the control unit changes the first conveyance member from the first speed to the second speed without performing the speed change processing in the conveyance operation.

4. The sheet conveyance apparatus according to claim 1, wherein in a case where the first conveyance member is changed to the third speed in the speed change processing, the control unit operates the first drive source to start changing the first conveyance member from the third speed to the second speed after the second conveyance member has exceeded the third speed.

5. The sheet conveyance apparatus according to claim 1, further comprising a sheet feeding portion configured to feed the sheet from a sheet storage portion configured to store sheets toward the first conveyance member, and wherein in a case where a detection time, which is an elapsed time from start of feeding of the sheet by the sheet feeding portion to detection of the sheet by the detection unit, is a first length, the control unit sets the first speed to a value less than a value of the first speed in a case where the detection time is a second length longer than the first length.

6. The sheet conveyance apparatus according to claim 5, wherein the control unit is configured to change a value of the second speed in accordance with the detection time and a progress of processing performed to the sheet at a predetermined position downstream of the second conveyance member in the sheet conveyance direction, so that a leading edge of the sheet reaches the predetermined position at a target timing.

7. The sheet conveyance apparatus according to claim 1, wherein the control unit is configured to determine a value of the third speed in accordance with the value of the first speed so that warping amount of the sheet, which increases by difference in speed between the first conveyance member and the second conveyance member during a period in the conveyance operation since drive of the second conveyance member is started until a speed of the second conveyance member catches up with a speed of the first conveyance member, is suppressed to a predetermined threshold or below.

8. The sheet conveyance apparatus according to claim 1, wherein the control unit is configured to set the third speed in the speed change processing to a value less than the first speed in a case where a value of the first speed is greater than a predetermined threshold speed.

9. The sheet conveyance apparatus according to claim 1, wherein the control unit is configured to set the third speed in the speed change processing to a value greater than the first speed in a case where a value of the first speed is less than a predetermined threshold speed.

10. The sheet conveyance apparatus according to claim 1, wherein in a case where a coefficient, which is determined based on a timing at which the detection unit detects the sheet and the first speed, is smaller than a ratio of the second speed to the first speed, the control unit executes the speed change processing in the conveyance operation by setting a product of the first speed and the coefficient as the third speed, and wherein in a case where the coefficient is equal to or greater than the ratio of the second speed to the first speed, the control unit changes the first conveyance member from the first speed to a speed equal to the second speed without executing the speed change processing in the conveyance operation.

11. An image forming apparatus comprising:

a sheet conveyance apparatus configured to convey a sheet; and an image forming unit configured to form an image on the sheet conveyed by the sheet conveyance apparatus, wherein the sheet conveyance apparatus comprises:

a first conveyance member configured to convey a sheet;

a second conveyance member arranged downstream of the first conveyance member in a sheet conveyance direction and configured to convey the sheet;

a detection unit configured to detect the sheet at a detection position upstream of the second conveyance member in the sheet conveyance direction;

a first drive source configured to drive the first conveyance member;

a second drive source configured to drive the second conveyance member; and a control unit configured to determine a value of a first speed for each sheet based on a timing at which the detection unit detects the sheet and to execute a conveyance operation in which a leading edge of the sheet in the sheet conveyance direction is abutted against the second conveyance member in a stopped state while the first drive source is driving the first conveyance member at the first speed, and then the second drive source starts to drive the second conveyance member with a target of a second speed while the first drive source continues to drive the first conveyance member, wherein the control unit is configured to execute a speed change processing, during the conveyance operation, in which the first drive source changes the first conveyance member from the first speed to a third speed that is smaller than the second speed before the second conveyance member reaches the second speed, and then changes the first conveyance member from the third speed to the second speed.

12. The image forming apparatus according to claim 11, wherein the image forming unit comprises an image bearing member configured to bear a toner image and rotate and a transfer member arranged downstream of the second conveyance member in the sheet conveyance direction and configured to transfer the toner image from the image bearing member to the sheet, wherein the control unit is configured to change the second conveyance member to a speed corresponding to a peripheral speed of the image bearing member after the second conveyance member is changed from either the first speed or the third speed to the second speed in the conveyance operation and before the leading edge of the sheet reaches the transfer member.

* * * * *